United States Patent [19]

Cash

[11] Patent Number: 4,616,852

[45] Date of Patent: Oct. 14, 1986

[54] MONEY DEBIT CARD APPLICATION FORM AND METHOD OF PROCESSING SAME

[76] Inventor: David J. Cash, LaGrange, Ill.

[73] Assignee: The Talman Home Federal Savings and Loan Association of Illinois, Chicago, Ill.

[21] Appl. No.: 674,564

[22] Filed: Nov. 26, 1984

[51] Int. Cl.[4] ..... B41L 1/22

[52] U.S. Cl. ..... 282/27 R; 282/1 R; 283/56; 283/62; 283/1 R

[58] Field of Search ..... 282/1 R, 1 A, 1 Z, 3 R, 282/12 R, 26, 27 R; 283/67, 1 R, 62, 56, 75

[56] References Cited

U.S. PATENT DOCUMENTS 1,413,123 4/1922 Kearney ..... 283/75 X 2,677,556 5/1954 Hill ..... 282/27 R 4,203,620 5/1980 Long ..... 283/54 X

*Primary Examiner*—Paul A. Bell

[57] ABSTRACT

A novel, multi-purpose printed form is provided. It consists of a longer upper section, which is a single sheet of paper with varied printing on both sides, and a lower section, that is a three-sheet combination which is initially secured to one another along the lower margin thereof. The sheets are readily separable by manual handling after entry of a four digit or so number, that is personally selected by the card applicant. This number will later be needed for all uses of the card in an automatic teller computer machine (ATM). The form serves to provide a tamper-proof method to generate the personal money debit card.

6 Claims, 4 Drawing Figures

MONEY DEBIT CARD APPLICATION FORM AND METHOD OF PROCESSING SAME

BACKGROUND OF THE INVENTION

The widespread use of plastic credit cards to make purchases of goods and services has been established in commerce for decades. A physically embossed number on the card serves to permit verification of the usability of the charge account against either printed lists furnished by the card user, or by resort to modern computer terminals against which the present validity of a credit card can be quickly checked. In the last decade or more, the cards have been "magnetically" imprinted with a multi-digit number, which a card user must program into the money center computer to make each and every banking transaction. The most critical transaction is a cash withdrawal from a properly funded account.

There are several known risks with the wide availability of the "magnetically-imprinted" cards. An unauthorized person needs only two items to access the account of another customer; these are: physical possession of a computer readable, "magnetic" debit card; and knowledge, from whatever the source, of the four digit personal identification ("PIN") that is "recorded" on the card. With these items, a wrongdoer can extract all of the cash over a period of time from another's personal account; until such time as the true owner recovers the card, cancels the account or ends access thereto based on the stolen card.

Financial institutions must retain much personal information in order to manage the great multiplicity of individual cards and machine access to the funds of those cardholders. One minor reason would be to avoid duplicate assignment of the same PIN number.

A particularly sensitive area for an institution issuing a card is the sanctity of a personal code which is breached by a dishonest employee of the bank. Clearly, the institution normally absorbs any such losses. It must take great care to prevent an inquisitive and malicious employee from gaining access to the bank's records to correlate the name on the money card with the magnetically recorded secret code under that name.

The compelling need should be apparent for a money debit card application form, the processing of said form, and a money card issuance system that precludes any ad hoc access by a bank employee to the vital correlation of customer name and PIN number. Such a system would be a highly desirable innovation with the popularity of ATM transactions.

OBJECTS OF THE INVENTION

It is an object of the invention to provide a money card application form that is "tamper-proof" as to bank personnel having access and handling.

It is another object to overcome the previous necessity for a money cardholder to make an in-person application at the financial institution for issuing such a money access card.

It is a further object of the invention to provide long distance to savers the ability to initiate issue of a money card, merely by proper completion of a specially constructed card application form, including personal identification number selection in private, and mailing of same to the holder of the funds in total security.

A yet further object is to employ only a portion of the application form, without customer identity being denoted thereon, to serve for entry of the PIN into the computer, whereby only the computer means would be able to correlate the customer account number and name with the PIN number card presentation for an ATM withdrawal transaction.

For yet another object, it is to devise a system for money card issuance which obviates the chance that any financial employee will be able to correlate the account and PIN numbers during the course of processing the card application.

Still another object is to provide one multiuse business form which serves as a combination of a debit money card application, a PIN selection form, and yields a customer-retained receipt for the PIN number he selects.

These and other objects and advantages are all achieved by the present invention, and how will become apparent to one skilled in the subject art, from the following description, reference now being made to the accompanying drawing, in which:

BRIEF DESCRIPTION OF THE INVENTION

PRESENTLY PREFERRED EMBODIMENT

Figure 1:
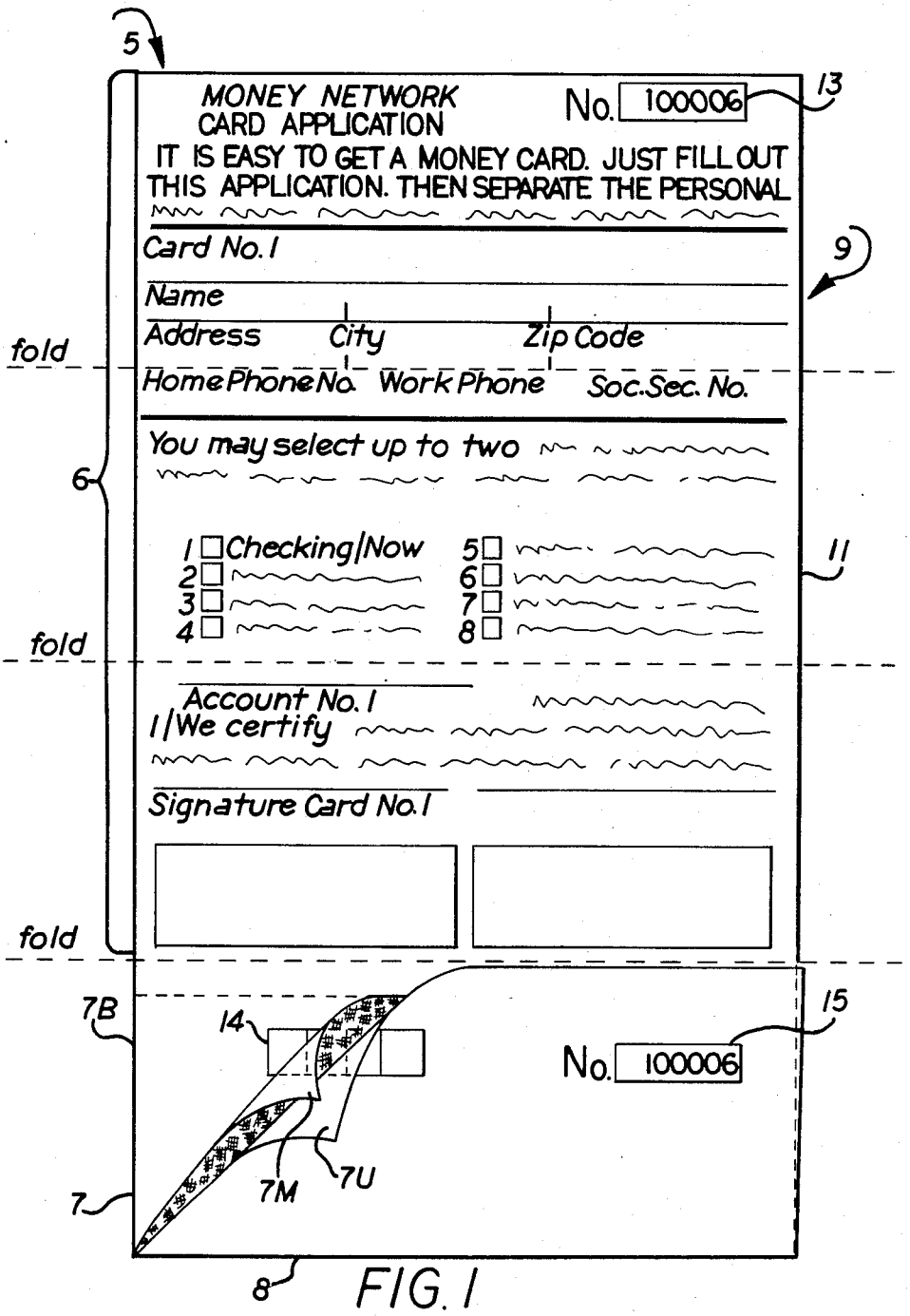
FIG. 1 is a perspective view of the inside face of the money account access application for entry card.

According to the invention, a novel, multi-purpose printed form, generally 5 in FIG. 1, is provided. It consists of a longer upper section 6, which is a single sheet of paper with varied printing on both sides (to be described), and a lower section 7, that is a three-sheet combination which is initially secured to one another along the lower margin 8 thereof. The sheets are readily separable by manual handling after entry of a four digit or so number, that is personally selected by the card applicant. This number will later be needed for all uses of the card in an automatic teller computer machine (ATM).

In the uppermost panel 9 of section 6 there is provided a plurality of blanks serving for biographical questions and adjacent spaces for entry of responses. Prime examples to be included are name, address, phone numbers, occupation, employer, saving account numbers, etc. These are dependent upon the amount of information that card issuer requires for card approval data. This data entry panel may be duplicated just below the first panel (not shown) for a similar data to be provided for a second card to be issued to the co-owner of the money access account which is to be drawn upon.

The middle panel 11 should probably be a recitation of options for use of the debit card, such as to draw cash (or deposit) from the cardholder's checking account, savings account, or money market account. The options would be picked out based upon those that the money institution wishes to offer its cardholders. Included in this panel would be lines for applicant's signature and application date, plainly necessary to form a binding agreement between cardholder and institution during the course of the use of the card.

A third, but optional inclusion, would be lowest panel 12 of the upper section where there would be spaces for notations denoting the processing and approval steps in both the card originating and office for card control usage. These records could readily be assembled on a separate sheet, but the risk of diversion of related elements of the office financial records are increased.

Lastly, as to upper section 6, there is provided a box 13 for permanent entry of a multidigit overt form serial number (the same number will be placed on lower section 7). This serves to correlate the upper and lower sections after they are separated by the applicant for distinct processing steps within the institution. The sequential numbering of forms also works to facilitate control of the inventory of printed forms and for regulation of form distribution.

Section 7 is, as stated above, the multisheet component of the form comprising a printed sheet 7U with detailed instructions for use of the section, and providing adjacent boxes 14 suited for manual entry of a several digit number, commonly four, which constitutes the personally selected PIN of the cardholder. This section has box 15, similar to box 13 of the upper section, bearing the indelible entry of the multidigit imprinted number (same on both) that serves to correlate the upper and lower sections in later processing.

Figure 2:
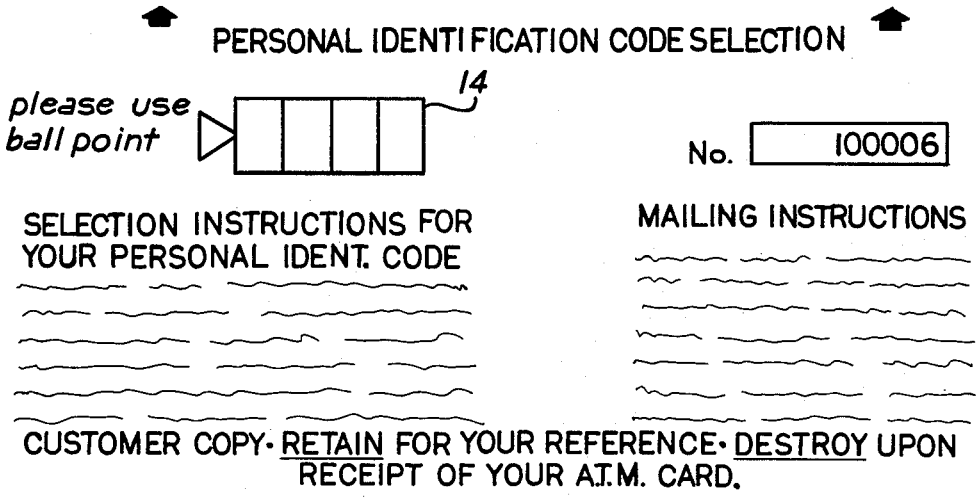
FIG. 2 is a plan view of the lower section of that application showing the data needed for selection of a personal PIN identification number entry.

FIG. 2 provides an exemplary version of the detailed instructions that would be included on the sheet 7U to assure its proper completion and processing by the institution.

The inside sheet 7M, which interleaves the front sheet 7U and back sheet 7B, is of a specially prepared paper adapted to transfer to the front face of sheet 7B, the identical PIN number which the card applicant impresses via ballpoint pen, or the like, on the upper face of sheet 7U. There are several types of such script transfer paper available, ranging from common carbon paper for making plural copies of an original document, to the carbonless NCR-type papers which are used in preparing multiple copies of a form, simultaneous with the entry of data on the uppermost sheet of such a form. Manufacture of these recording papers are covered by U.S. Pat. Nos. 3,193,404 and 3,278,327.

The lowest sheet 7B has only a box 14 for recordal of a number which is identical with the position of that box on data entry sheet 7U. The typical imprinted No. 100006 is also found on this sheet. The nature of transfer sheet 7M is selected to insure that a permanent recordal for the several digit number occurs on the upper face of bottom sheet 7B. On the obverse side of sheet 7U there is no more than a second business reply mail legend, also directed to the same card issuing agency, but preferably to a different echelon thereof. This split will preclude one agency employee from gaining access to both the identity of the cardholder and his secret PIN number which are needed for card use.

Figure 3:
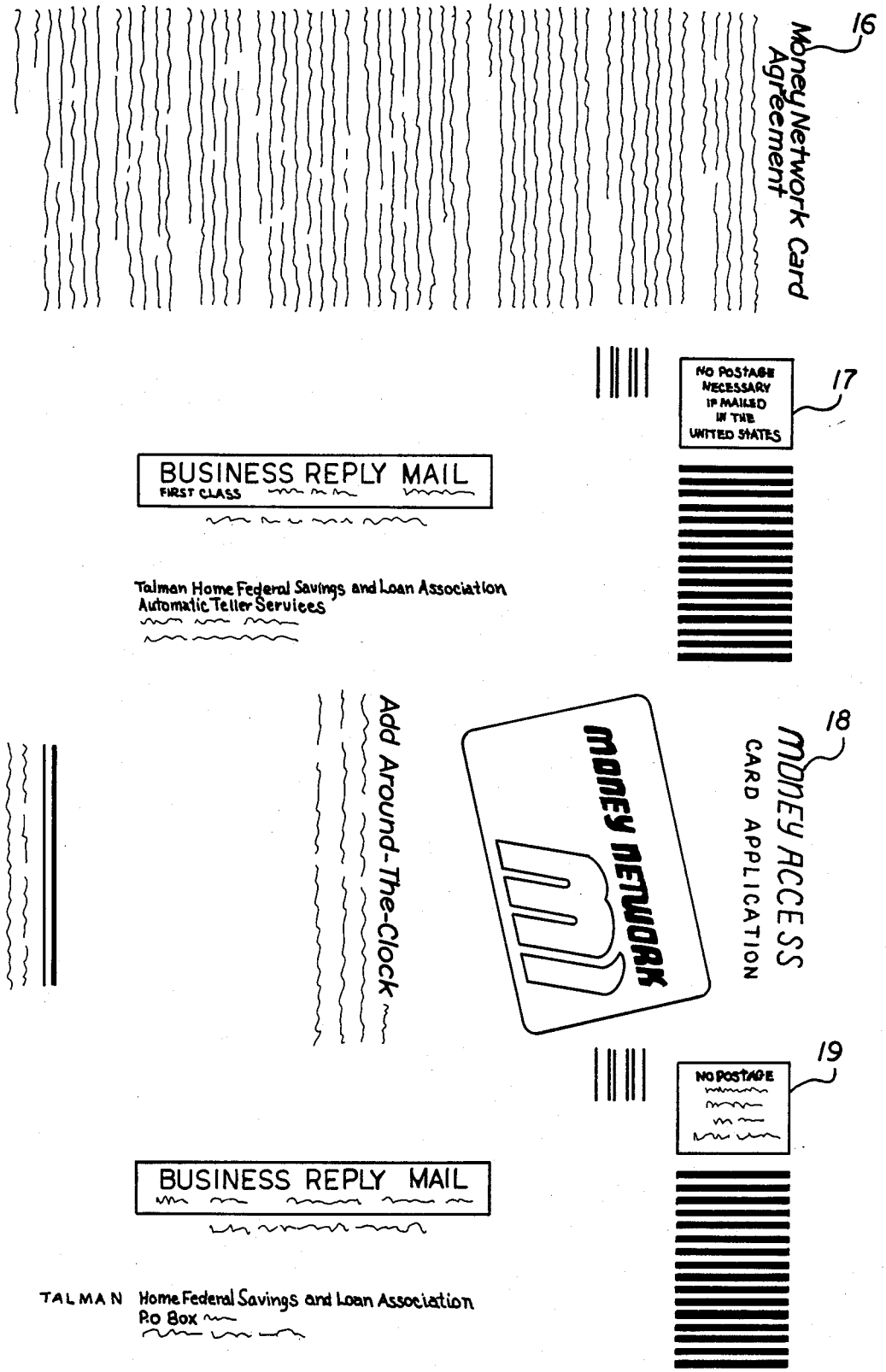
FIG. 3 is a perspective view of the obverse (outside) face printed matter of the card application of FIG. 1.

Now referring to the obverse side of application form 5, the various parts will be described as to their essential or optional purpose with this novel article of manufacture by reference to FIG. 3. The upper panel 16 of this sheet is the opposite outside face to the personal data entry panel 9 of upper section 6. It is optionally provided with promotional copy and or pertinent information about the rules for card usage. In one preferred version, there will be a printed recital of the terms and conditions of the money card usage agreement, the specifics of which are not pertinent to the present disclosure but rather are a matter of financial practices and law.

The middle panel 17 has imprinted thereon a standard business mail reply legend, perhaps with a prepaid postage designation, addressed to the special echelon of the card issuing institution which will retain the data need for account approval and for money card issuance. The lowest panel 18 of first section 9 has printed materials outlining the contents of the enclosed application form, perhaps some promotional statement, and the identity of the offering institution. Also it may show a full size replica of the appearance of the card that will issue upon application approval. Such elements are wholly a matter of design and promotional goals.

The fourth panel 19 is the obverse side of sheet 7B of lower section 7. It's content is important since it will serve as the mailable sheet that transmits the PIN number (and correlating imprint #) to the card issuing institution. Preferably, this data will go to a different mailing echelon of the insurer rather than to the address for the full application itself. Otherwise, the mailing privilege notations will be the same. The hidden obverse side 7B will, of course, bear the imprinted inventory or account number found on the upper section 9 as well.

Figure 4:
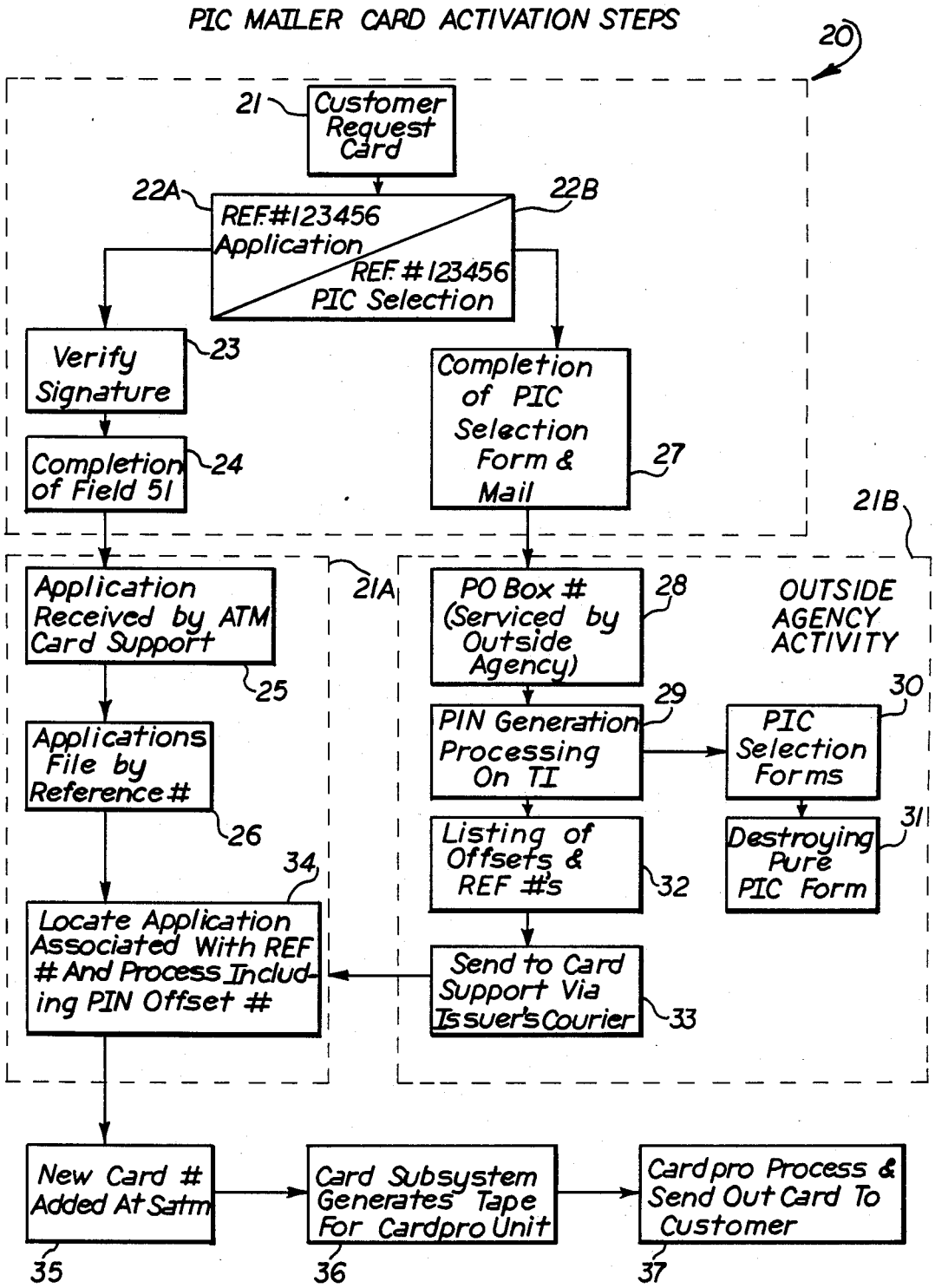
FIG. 4 is a flowchart of the steps needed for the activation of the money account debit card to be generated by a mail (or personal) application.

The processing of the two sections of the form, after detachment and mailing, will now be described in connection with FIG. 4, which is a schematic representation of the processing steps. The dotted lines represent the groups of steps handled exclusively by one of the three entities involved in the handling of this card.

Within the zone, generally identified by numeral 20, are the steps needed to be conducted by the card applicant and perhaps assisted in by a bank clerk; but all are to be effected before the private selection of a PIN number. Within zone 21A are the steps to be conducted by the financial echelon which receives via direct mail the completed first section of the card application 6 (FIG. 1).

Within zone 21B are the steps to be conducted by a physically separate echelon of the financial institution (or by an appointed outside agency) which receives only the returned mailer sheet 7B, bearing the indelibly inscribed PIN number along with the earlier imprinted inventory control number.

In one approach to completion of the form, a person with an established checking and/or savings account visits his nearest savings and loan office and has the institution official enter the personal data on a remote computer terminal (CRT screen). (Step 21) This includes name, address, phone numbers, social security and checking account number to be linked to the card upon issue. After data verification by the customer, the data may be printed out on one of the novel forms taught herein (step 22A). The official verifies the signature on the card application against the authenticated signature for the existing money accounts (step 23). Alternately, the signature is verified when the mailed application arrives.

In step 24, COMPLETION OF FIELD 51, reflects that an activated card can be placed on the system by a counselor. However, an alternative is having it done by ATM Card Support Unit to maintain control of activated cards being sent by mail.

In step 25, APPLICATION RECEIVED BY ATM CARD SUPPORT, they are checked for correct account numbers, customer's and counselor's signatures. The originating office, which receives credit for taking the application. A courier delivers the applications daily the ATM Card Support Unit.

In step 26, APPLICATIONS ARE FILED BY REFERENCE #, and are retained by the ATM Card Support until the offset number list is received from the issuer's ouside computer service organization for his ATM operating units (SATM).

Reverting back to step 22B, REF #123456 PIC SELECTION, the form/envelope (FIG. 1) is detached from the application for the customers to pesonally choose their four digit number (personal or teller) identification code (PIN).

In step 27, COMPLETION OF PIC SELECTION FORM AND MAILING, the postage-paid PIN envelope to the special P.O. Box are done by the customer. The PIN form copy with the printed serial reference number is retained by the customer until they receive the activated card by mail. Several steps occur before the last event.

In step 28, the P.O. BOX # (SERVICED BY OUTSIDE AGENCY), is located in the isolated post office, retained by an outside agency, set up by Issuer's SATM to record mail addressed to the Issuer. SATM arranges for regular courier pickup (daily) from the agency to the SATM center.

In step 29, PIN GENERATION PROCESSING, occurs the conversion of the customer's PIN into a coded number, by the data processing input terminal and the PIN Selection form is date stamped and placed in sequential order by SATM personnel.

In ancillary step 30, PIN SELECTION FORMS (as originated by the customer) are retained with the copy coded number list in the SATM's vault for a week, followed by step 31, in DESTROYING PURE PIC FORM, which is done with a paper shredder at the SATM.

In step 32, LISTING OF OFFSETS AND REFERENCE NUMBERS, are generated for the Card Support Unit as a result of the SATM code conversion. If there are no PIN forms received for a day, the list will reflect "0 ".

In step 33, SEND TO CARD SUPPORT VIA ISSUER'S COURIER, the next working day the offset list and reference numbers are sent.

The earlier steps in zone 21A and 21B now converge in step 34 to LOCATE APPLICATION ASSOCIATED WITH REFERENCE NUMBER AND PROCESSING INCLUDING PIN OFFSET NUMBER. These are completed by Card Support Unit the same day as the offset list is received from SATM. The PIN offset number is written on the application in lower right corner where there is found the SATM mark.

In next step 35, NEW CARD NUMBER ADDED AT SATM along with the customer's name, address, account number, and offset number by Card Support staff through the data processing input terminal (TI). The TI logs are checked and edited by the Card Support Unit on the following work day.

In step 36, CARD SUBSYSTEM GENERATES THE TAPE FOR CARDPRO UNIT, a tape is sent thru the Card Support's computer link to the SATM. SATM forwards the then produced tape to the Cardpro Unit.

Finally, in step 37, CARDPRO PROCESS AND SEND OUT CARD TO CUSTOMER, Cardpro checks for correct names and addresses before mailing the activated cards with an enclosure stating this is the "Money Network Card" you applied for.

It will be appreciated that the foregoing detailed description is given by way of illustration of the best mode presently to use the invention. Other embodiments and variations will occur to those reading this description without departing from the spirit, scope and claims of my invention.

What is claimed is:

1. As an article of manufacture, a printed form comprising a manually detachable first and second sections, with each side of said form bearing reading matter of differing content the entire first section further comprising on one side an application for issue of a money account debit card that is adapted for use in automatic computing machines and bearing an overt serial number on said one side, and the obverse side of which form has in part a return mail legend directed to a debit card issuing agency, the separable second section further comprising a three sheet form, which sheets are manually detachable from each other with the obverse side of the lowest sheet consisting of a second return mail legend directed to the same card issuing agency, said the second section further comprising the following elements:

a. a printed instruction top sheet providing space for entry of a several digit number to constitute the personal identification number (PIN) of the card applicant and also reciting instructions for proper disposition of the second section components after their separation from the upper first section;

b. a paper sheet interleafing the front and back sheets and adapted to record the number manually entered on the front side of the front sheet to the front side of the back sheet;

c. the back sheet being adapted to permanently record the said entry number on its face as an identification code; and d. both of the top and back sheets displaying the said serial number as in the first section, thereby serving to correlate the biographical data of said applicant with said identification number when needed.

2. The article of claim 1 in which the one side of the first section further comprises questions and answer spaces to elicit data for card approval and also to indicate for applicant choices among the account options available for use with the card to be issued.

3. The article of claim 1 in which the obverse side of the first section includes in part the printed terms and conditions of an agreement for automatic teller machine use of the debit card.

4. The article of claim 1 in which the multiple digit serial number comprises at least five digits which are imprinted on the blank application forms in a serial manner to facilitate control of inventory and form distribution.

5. The article of claim 1 in which said number transferring sheet interleaf comprises one face having a carbon coating like that provided for conventional carbon copy typing paper.

6. The article of claim 1 in which the several digit identification code is not more than four digits.

* * * * *